United States Patent [19]

Shiver et al.

[11] 4,035,251

[45] July 12, 1977

[54] METHOD AND APPARATUS FOR REDUCTION CELL CONTROL

[75] Inventors: Harry T. Shiver; William E. Campbell, both of Portland, Oreg.

[73] Assignee: Reynolds Metals Company, Richmond, Va.

[21] Appl. No.: 188,737

[22] Filed: Oct. 13, 1971

Related U.S. Application Data

[63] Continuation of Ser. No. 769,434, Aug. 21, 1968, Pat. No. 3,622,475, which is a continuation of Ser. No. 400,059, Sept. 29, 1964, abandoned.

[51] Int. Cl.[2] ..... C25C 3/06; C25C 3/14; C25B 15/08

[52] U.S. Cl. ..... 204/67; 204/228; 204/245

[58] Field of Search ..... 204/67, 243 R–247, 204/228

[56] References Cited

U.S. PATENT DOCUMENTS

| | | | |
|---|---|---|---|
| 1,837,070 | 12/1931 | Roth | 204/245 X |
| 2,933,440 | 4/1960 | Greenfield | 204/67 |
| 3,434,945 | 3/1969 | Schmitt et al. | 204/67 |

*Primary Examiner*—John H. Mack
*Assistant Examiner*—D. R. Valentine
*Attorney, Agent, or Firm*—Glenn, Palmer, Lyne & Gibbs

[57] ABSTRACT

Method of operating (and apparatus including) an electrolytic cell for the production of aluminum, in which provision is made for monitoring the cell resistance, producing feed control signals responsive to cell resistance changes, and regulating the feeding of alumina into the bath in accordance with such signals.

28 Claims, 4 Drawing Figures

METHOD AND APPARATUS FOR REDUCTION CELL CONTROL

BACKGROUND OF THE INVENTION

This application is a continuation of Ser. No. 769,434 filed on Aug. 21, 1968, now U.S. Pat. No. 3,622,475 which, in turn, is a continuation of now abandoned Ser. No. 400,059 filed on Sept. 29, 1964.

This invention relates to the control of reduction cells and, particularly, to a method of operating electrolytic cells for the production of aluminum.

The production of aluminum by electrolysis of an aluminum containing compound, e.g., alumina, $Al_2O_3$, is a very old process. The alumina is broken down into its components, the oxygen is liberated at the anode and the aluminum is deposited at the cathode. Conventionally, use has been made of two types of electrolytic cells, viz., that commonly referred to as a "prebake" cell and that commonly referred to as a "Soderberg" cell. In the prebake cell the anode comprises a number of individually adjustable carbon blocks that are prebaked before being installed in the cell, while in the Soderberg cell or continuous anode cell the anode comprises a single large mass of carbon that is baked in situ during operation of the electrolytic cell, thereby utilizing part of the heat generated by the reduction process. In either case the molten salt bath is covered by a crust of frozen electrolyte and alumina which diminishes heat losses from the cell.

It is conventional practice to control the operation of an alumina reduction cell by periodically breaking in the crust (in order to introduce alumina into the bath), and by periodically adjusting the anode-cathode spacing (known as the "A-C distance"), both of which control steps have the effect of changing the cell resistance, the latter, by varying the electrical resistance path through the bath between the anode and cathode, and the former, by changing the concentration of alumina dissolved in the bath. While it is theoretically possible to keep the bath concentration constant in order to evaluate the effect of varying A-C distance, and vice versa, it has been difficult to devise a way of applying such information in the control of cell operation, largely because actual alumina concentration in the bath at a particular time is not readily determined except by direct sampling and analytical procedures which are time-consuming and impractical for continuous or frequently repeated use, and also because it is difficult to make a direct physical measurement of the A-C distance with sufficient accuracy. Accordingly, the exercise of operating control by varying alumina concentration and changing the anode bridge setting has required the exercise of considerable expertise and subjective judgment on the part of skilled operators. It has been customary to allow wide variations in cell performance between a relatively starved condition (low alumina concentration), leading toward the "anode effect", and an overfed condition (at or above the saturation point) leading toward "sickness" of the pot due to sludging or temperature instability. In this regard, however, some attempts are indicated in the prior art to impose various restraints on cell operation, such as circuit means to anticipate an anode effect and avoid a "light" before it occurs, or alumina feeder devices to enable closer control over the rate of feeding alumina into the bath. The difficulty still remains that control of the cell by varying the alumina concentration and changing the A-C distance independently of each other, without some readily applied objective standard of cell performance in response to such control actions, necessarily produces an uncertain result.

With the foregoing problems in mind, work was undertaken to evaluate the respective influences of alumina concentration and A-C distance on cell behavior; and it was discovered that, at constant A-C distance and otherwise stable operating conditions, the characteristic resistance curve (cell resistance vs. alumina concentration) is convex downwardly, indicating the existence of a minimum value or values of the cell resistance component due to alumina concentration. Furthermore, the family of similar cell resistance curves for different values of constant A-C distance was discovered to exhibit a locus of these minimum resistance points occurring at substantially the same concentration of alumina in the bath. Stated differently, this experimental effort led to the conclusion that, regardless of A-C distance, there is an optimum alumina concentration or narrow range of concentrations for any reduction pot providing the lowest cell resistance which is attainable in relation to alumina content of the bath. The foregoing observations also led to the conclusion that detected changes in cell resistance during the reduction operation might be used as a means of determining the corresponding changes in alumina concentration, thereby providing a method of controlling the feeding program to obtain any desired response of the cell in this regard.

The problem remained, however, that the absolute value of cell resistance would not necessarily be a valid control function if the bath resistance were varied to an unknown extent by sporadic changes in A-C distance. Further observations of cell performance have indicated that A-C distance is not materially altered for conventional cells over a substantial period of the time between successive tapping operations to remove accumulated aluminum, primarily because the rate of decrease in A-C distance occasioned by increasing volume of molten aluminum in the cell is offset to a great extent by the progressive consumption of carbon anode materials tending to increase the A-C distance; and in any event, such imbalance as may exist can be compensated by selective adjustment of the actual anode-cathode spacing. Thus, it has been found that improved cell performance may be achieved by operating at a substantially constant (or otherwise defined) A-C spacing based upon a selected criterion such as maximum production in terms of Kw hr/lb, while controlling the cell resistance (or voltage, where current is constant) by means of a feeding program in which additions of alumina are made in response to predetermined changes in a function of alumina concentration, such as the cell resistance. It has also been found that A-C distance can be controlled more accurately if periodic adjustments thereof are made at substantially the same bath alumina concentration. This permits closer analysis of the effects of A-C distance on operation of the cell than had been possible with the prior art practice in which adjustments were made substantially without regard to changes in cell resistance due to varying alumina concentration.

An illustration of how this may be accomplished in practice is the following. The reduction cell is provided with an alumina feeder having two rates of feed, one less than the rate of depletion of bath alumina content as aluminum is produced, and the other, a greater rate.

Operation of the cell following startup proceeds with the feeder set at either one of these feed rates, for example, the lower rate, with the A-C distance at a predetermined setting. Upon detection or prediction of increasing cell resistance, the feeder is switched to the higher rate and left at that setting until the tendency toward increasing cell resistance is slowed, stopped or reversed. Upon detection or prediction of subsequently increasing cell resistance, indicative of the alumina concentration reaching a value on the opposite side of the minimum point of the cell resistance curve, the feeder is switched back to the lower setting. Further feeder adjustments continue along the same lines. Depending upon the selected range of variation in ore content for control purposes, the cell resistance thereby can be kept substantially constant at or near the lowest resistance in terms of alumina concentration.

Alternative modifications of this general procedure may be employed to maintain the cell resistance within other prescribed limits. In the case of Soderberg cells, for example, the difficulty in distributing alumina throughout the bath may necessitate operating entirely on the lean side of the alumina concentration, at a cell resistance somewhat greater than minimum.

A further aspect of the invention concerns detection of excessive ore content tending toward a sludging or overheating effect, and a method of distinguishing malfunction of the cell in this regard from similar upsets occasioned by low carbons in a prebaked anode. It has been otherwise determined that the alternating current component of voltage superimposed on the DC voltage applied to the cell is a reliable indicator that a low carbon exists, i.e. that one or more of the carbon blocks in a pack is set too close to the cathode compared with others, so that the low carbon carries a disproportionately high current. In accordance with the present invention, however, it has been found that a sensing system based upon this technique may also be employed to detect undesirable sludging conditions in the cell, and, according, if the cell has recently received a massive feeding (as by breaking in the crust at some point in its operation, such as may occur at start-up), or has recently been tapped to remove aluminum, the apparent indication of a low carbon in this manner may be interpreted rather as indicative of the need to reduce the rate of feed or even shut off the alumina feeder altogether for a period of time until the indicator has returned to normal. This knowledge serves to extend the applicability of resistance control to periods of operation including various upsets associated with the periodic massive feeding or removal of aluminum from the cell.

For a better understanding of the invention and its various objects, advantages and detail, there follows a detailed description in conjunction with the accompanying drawings, in which.

Figure 1:
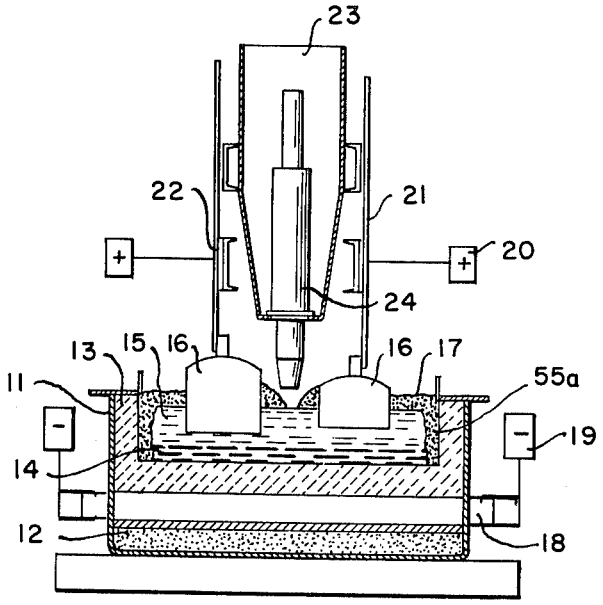
FIG. 1 shows schematically an alumina reduction cell.

An alumina reduction cell suitable for purposes of the invention is shown schematically in FIG. 1, including a steel shell 11 lined with an insulating layer 12 and a carbonaceous conductive lining 13. Iron rods 18 embedded in the lining 13 are connected with a cathode bus 19. The lining 13 contains a pool of molten aluminum 14 and a bath 15 of alumina dissolved in molten electrolyte. Other forms of linings and cathode constructions can be used to contain the molten aluminum 14 and bath 15 to impress a cathodic potential on the molten aluminum 14, such as a non-conductive lining and a conductive cathode element (e.g. titanium diboride or the like) extending into contact with the molten aluminum.

Suspended above the electrolyte, and partially immersed therein, is a carbon anode which may be formed of individually adjustable prebaked carbon blocks 16, as shown, for a conventional multiple-anode type cell, or which may consist substantially of a large mass of carbon adjustable only as a unit, for a conventional Soderberg type cell. Molten electrolyte 15 is covered by a crust 17 which consists essentially of frozen electrolyte constituents and additional alumina. As alumina is consumed in electrolyte 15, more alumina may be fed into the electrolyte by breaking in a portion of crust 17 or, preferably, by use of a mechanical alumina feeder 24 (e.g., the positive metering type described in copending application Ser. No. 342,388 of A. J. Kiley and H. T. Shiver filed Feb. 4, 1964, now U.S. Pat. No. 3,371,026). A supply of alumina for the feeder 24 or for replenishing the crust is maintained conveniently in a bin 23. Anode 16 is supported from anode rod 21 which is removably clamped to bridge bus 22, which in turn is electrically connected to anode bus 20. The anode bus 20 and cathode bus 19 are connected to the respective poles of a suitable source of electrolyzing current.

By virtue of the applied electromotive force, or voltage, the electrolyzing current is forced to flow through the aforesaid electrical connection means and through the molten electrolyte layer 15 between the anode 16 and the molten aluminum pool 14, whereby alumina dissolved in the molten electrolyte layer is electrolyzed into its constituents, with aluminum metal accumulating in the molten aluminum layer 14, the oxygen being liberated substantially in combination with the carbon of anode 16 and escaping the cell as carbon monoxide and carbon dioxide gases through holes in crust 17. Accumulated aluminum is siphoned from the molten aluminum pool 14 periodically, ordinarily at regular intervals of 24 to 48 hours. Anode carbon is replenished by periodically replacing blocks 16 in multiple-anode cells or by adding fresh carbon paste to the top of self-baking Soderberg anodes.

The amount of carbon monoxide gas generated at the anode is believed to indicate the degree of cell inefficiency, and is generated in increased amounts during periods of cell upsets caused by: maladjustment of the anode carbon blocks 16; slude accumulations partially covering the contact surface between molten aluminum pool 14 and the cell lining 13; excessively high temperatures in the molten contents of the cell; and other factors that may arise when the cell is not operated at optimum conditions.

Figure 2:
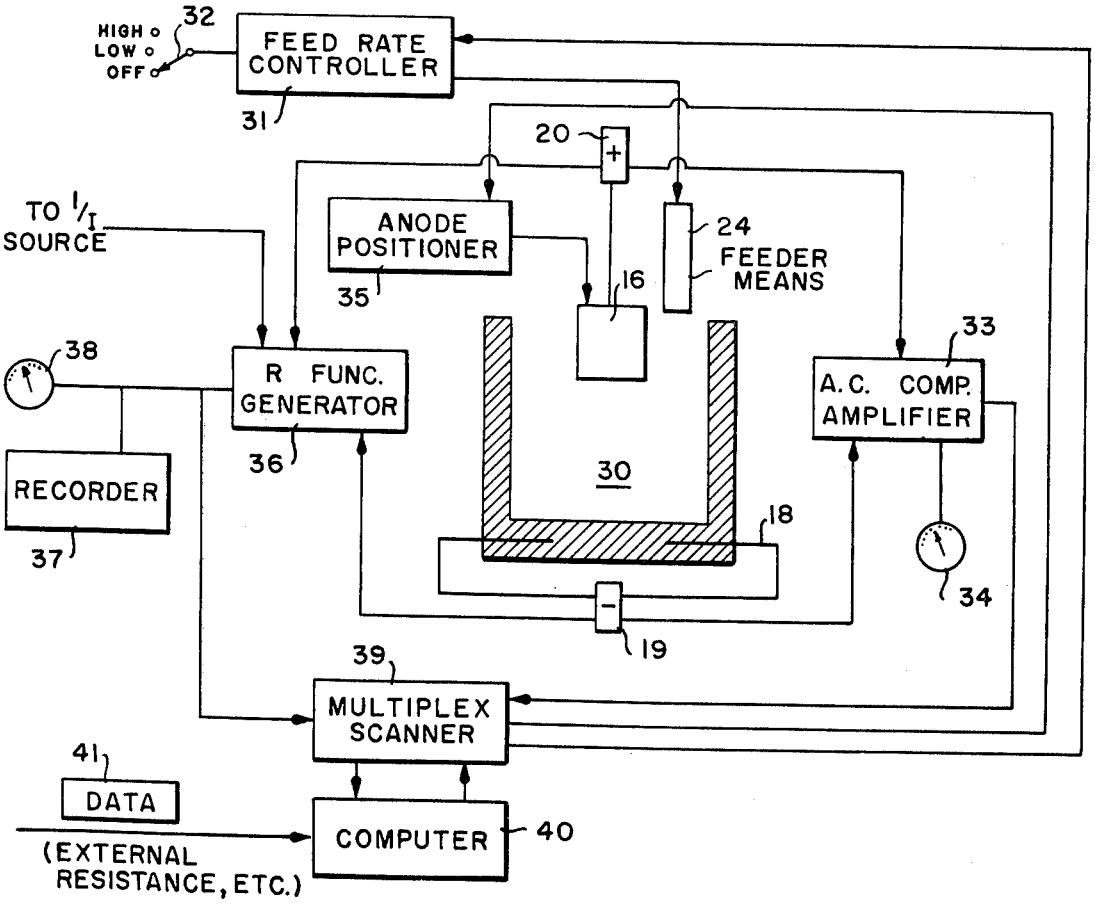
FIG. 2 illustrates a reduction cell diagrammatically with associated sensing and control means useful in accordance with the invention.

The sensing and control means utilized in the control system of the present invention are shown diagrammatically in FIG. 2. Associated with the cell 30 are cathode bus 19, anode bus 20, anode 16, and feeder means 24 as in FIG. 1. Anode 16 is provided with anode positioner means 35, which may be a manually operated chain or motor by which the operator causes anode 16 to move up or down, and which in the present example also is responsive to a signal from computer 40 through scanner 39. Feeder means 24 is actuated by a feed-rate controller 31 to control the feeding of alumina into cell 30 at one of at least three settings - off, high and low - as determined by operation of three-position switch 32.

A cell voltage alternating current component amplifier 33, in electrical connection with cathode bus 19 and anode bus 20, detects amplifies and integrates a portion (in the frequency range of about 1 to 20 cycles per second) of the alternating current voltage component superimposed on the essentially DC voltage acting between cathode bus 19 and anode bus 20, and supplies a signal proportional to the amplitude of said alternating current component for display on meter 34 and for reading by computer 40 through scanner 39. A device suitable for this purpose is the subject of copending application Ser. No. 342,505 of Robert V. Brown filed Feb. 4, 1964, now U.S. Pat. No. 3,345,273. The alternating current component can be used as an indication of upset conditions in the cell caused by maladjustment of anode blocks relative to each other or by sludge accumulations, as hereinafter discussed.

Resistance function generator 36 provides a signal proportional to the cell resistance which is displayed on recorder 37 or meter 38 and may be read by computer 40 through scanner 39. Resistance function generator 36 may comprise a Hall effect generator wafer, supplied with an input DC current proportional to the reciprocal of the line (or cell) current I. The wafer is disposed between the poles and within the air gap of an electromagnet, powered by a current proportional to the difference between (a) the voltage $E_p$ acting between the cathode bus 19 and the anode bus 20, and (b) a predetermined constant voltage K, whereby the output Hall effect voltage is proportional to the product of (E-k) and 1/I, as described in detail in copending application Ser. No. 399,403 of Lester H. Wolgast filed Sept. 25, 1964, now U.S. Pat. No. 3,387,210. Alternatively, cell resistance may be calculated from data presented to the computer 40, thus eliminating the need for resistance function generator 36. Because the aforementioned superimposed alternating current component of the cell voltage may create small fluctuations in the output of generator 36, recorder 37 and meter 38 are preferably provided with suitable damping means and the signal read by computer 40 is preferably integrated over 1 or more seconds before reading.

The scanner 39 connects computer 40 in a response to a program with the output signals from each of a plurality of serially connected cells being controlled, either sequentially or on command of the computer program or operator as may be desired. The computer 40 is provided with suitable input means 41 for the reception of additional data.

Figure 3:
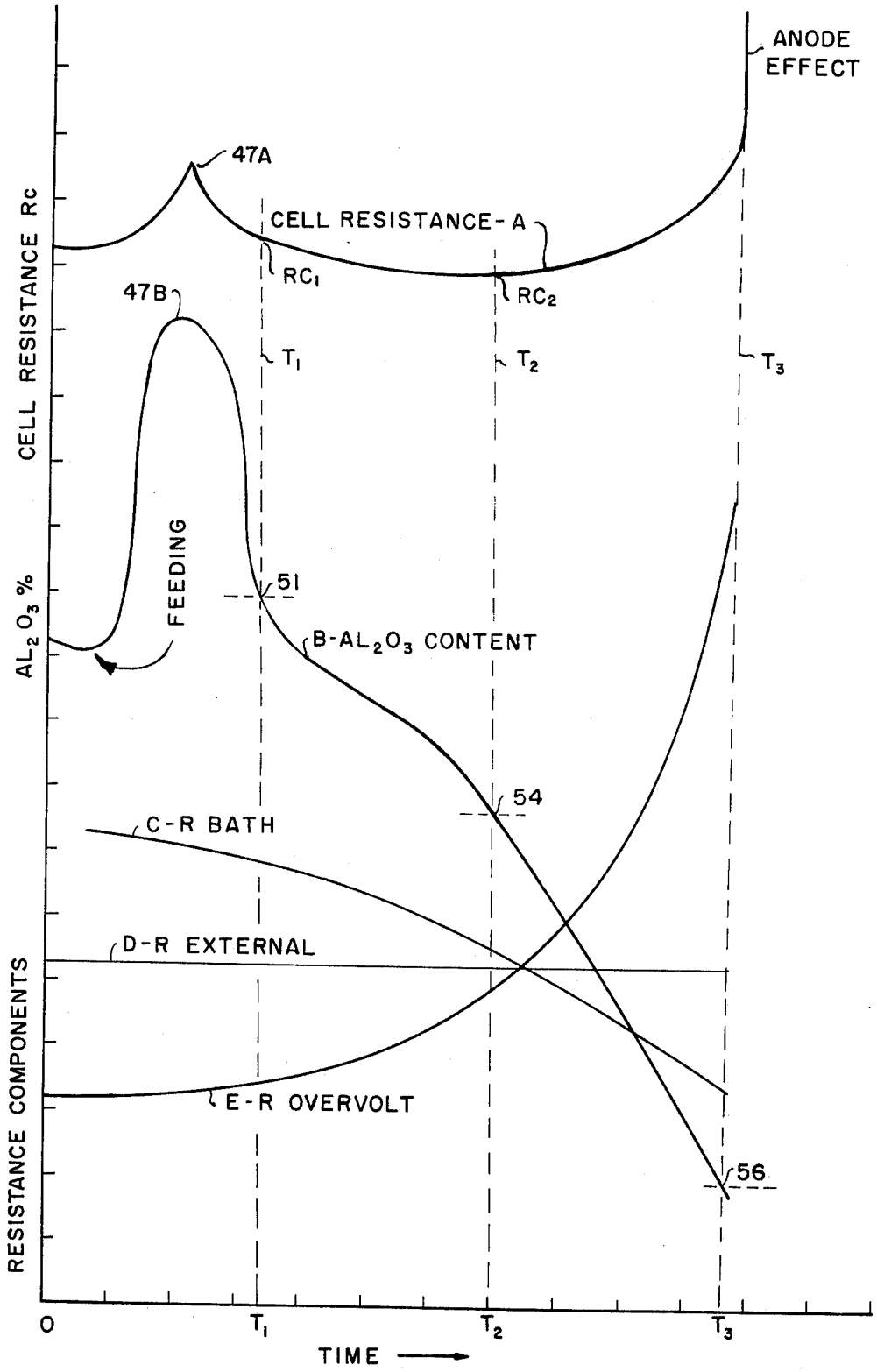
FIG. 3 illustrates typical variations with time of bath alumina concentration and resistance of an alumina reduction cell.

Referring next to FIG. 3, curve A indicates the resistance of an alumina reduction cell operating at substantially constant A-C distance over a period of time, and curve B is a smoothed representation of the bath alumina content as determined by chemical analysis of samples of electrolyte taken from the cell at appropriate times. The curve A (cell resistance ) is the summation of curves C, D and E which represent the resistance components $R_{bath}$, $R_{external}$ and $R_{overvoltage}$, respectively. In the operation represented by these curves, the cell was given a feeding of alumina by breaking in a portion of the crust 17 in the conventional manner and electrolysis was then allowed to proceed without further mechanical feeding until the alumina content was depleted to the point that an "anode effect" occurred. From the peak 47B just prior to time $T_1$ it is observed that feeding by the conventional method resulted initially in an excessive alumina content in the molten electrolyte 15 and, further, that the excess portion thereof was depleted at a greater rate than occurred subsequently. This rapid decrease of alumina apparently is caused by precipitation of alumina as sludge onto the electrical contact surface between cell lining 13 and the molten aluminum pool 14, which in turn causes overheating and lowers cell efficiency. Following time $T_1$ the cell resistance declined more slowly to a minimum value $R_{c2}$ at time $T_2$ corresponding to alumina content 54, after which the resistance rose rapidly as the alumina content declined further until at time $T_3$ (corresponding to alumina concentration 56) an anode effect was observed.

Figure 4:
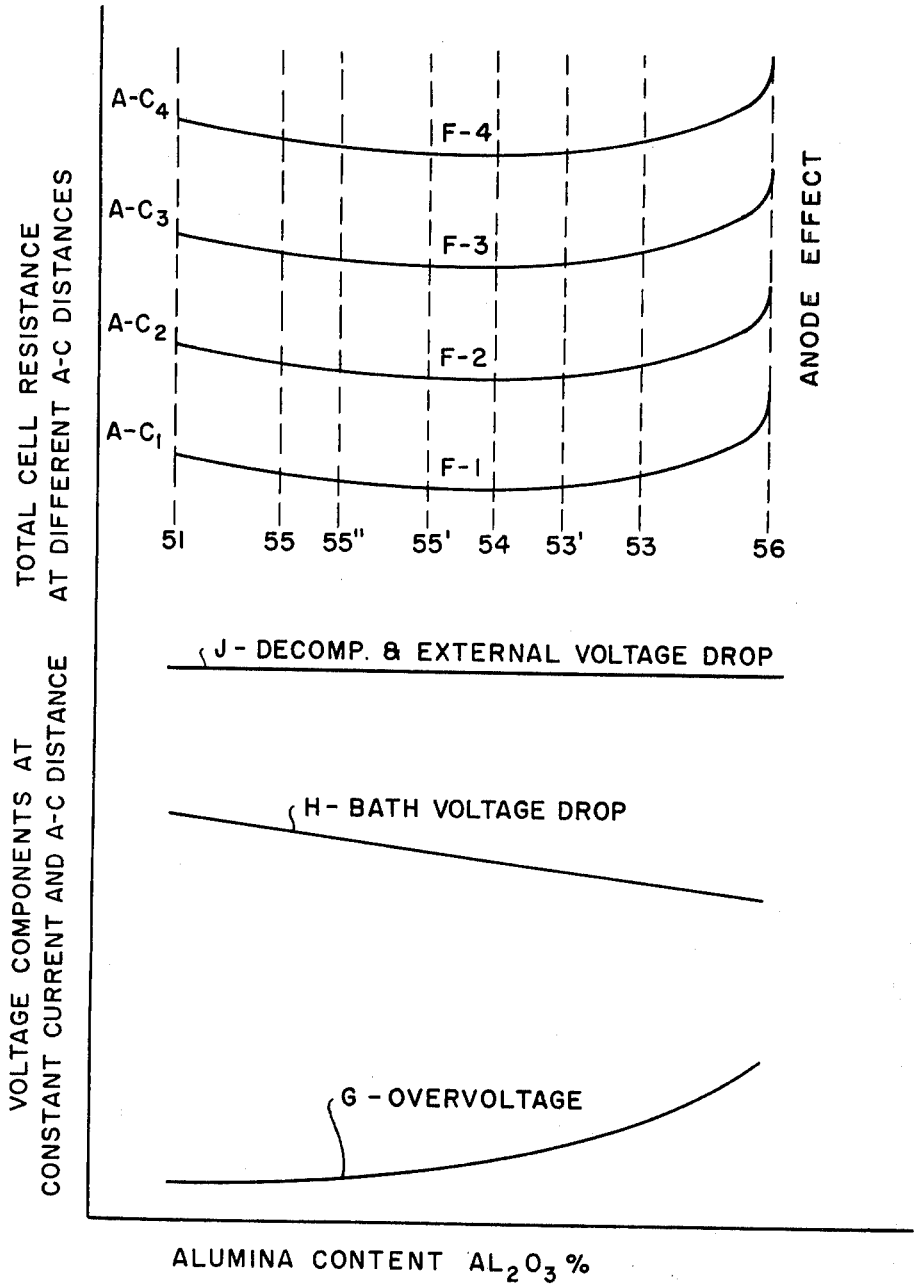
FIG. 4 illustrates the variation with bath alumina content of total cell resistance at different A-C distances, and of the various components of cell voltage of an alumina reduction cell operating at a constant A-C distance and constant cell current.

Referring to FIG. 4, the family of curves $F_1$, $F_2$, $F_3$ and $F_4$ illustrates the variation of total cell resistance $R_c$ relative to bath alumina concentration for different constant values of A-C distance, over the range between the maximum ore content 51 that is soluble in the bath under normal cell operating conditions and the concentration 56 at which the anode effect occurs. When the cell current also is maintained substantially constant, the variation of cell voltage likewise exhibits the form indicated for cell resistance at the top of FIG. 4; and curves G, H and J at the lower part of that figure represent components of such voltage. While the present disclosure emphasizes resistance control, thereby eliminating the necessity for maintaining the current constant, it will be appreciated that voltage control may be employed in accordance with the present invention under conditions imposing constant current.

It is seen from curve $F_1$ of FIG. 4 that the corresponding cell resistance decreases from an alumina content 51 through points 55, 55'' and 55' to a minimum value at 54. Without feeding, the cell resistance passes through such minimum value and thereafter increases through higher values at 53' and 53 until it reaches the point 56 at which the resistance increases rapidly and the cell goes into an anode effect. It has been discovered, furthermore, that a surprising characteristic of the family of curves $F_1$, $F_2$, $F_3$ and $F_4$ is that all pass through their respective minimum values (where rate of change of $R_c$ is zero) at about the same alumina concentration point 54, indicating that there is a substantially optimum bath alumina concentration for a given reduction cell over a wide range of A-C distances. This discovery means that, by observing and utilizing the cell resistance characteristic, having once determined the foregoing wave forms, the cell may be operated continuously at or near optimum bath alumina concentration without need for periodically determining the bath concentration through direct analysis.

The particular values of bath alumina concentration corresponding to points 51, 54 and 56 depend upon various design and operational parameters, and values of cell resistance corresponding to various alumina concentrations also are dependent on these parameters and especially on A-C distance of the cell. Having determined and spaced the cell anode and cathode at the desired A-C distance for any particular cell, however, it is unnecessary to consider these other parameters in routine control operations. Thus, a predetermined optimum bath alumina concentration is provided by reference to curve A, and feeding of the cell thereafter is based on observation of the variations of cell resistance as displayed on indicator 38 or preferably on recorder 37.

Referring again to curve $F_1$ of FIG. 4, as alumina is consumed through electrolytic action it will be observed at the ore content 53 that the cell resistance is increasing, and the operator will feed the cell as by breaking in a portion of crust 17 that in his judgment will raise the ore content of the cell to a value 55 not greater than the value 51 above which sludging occurs. At each feeding he may sharpen his judgment as to the amount of crust to be broken in by watching the variation of resistance with time and particularly by noting the presence or absence of the resistance hump 47A illustrated on curve A of FIG. 3. As the electrolytic action proceeds the ore concentration will decrease again to the value 53; and the operator will again note the increasing cell resistance and feed the cell, thus effectively controlling the bath alumina concentration between the limits 53 and 55. The limits for control purposes may be sensed in terms of differences in the absolute value of cell resistance as well as changes in the magnitude or sign of the slope of the resistance curve within the selected control range.

When the cell is equipped with feeder means 24 and feed rate controller 31, the operator or computer system will, upon sensing at the alumina content 53 that the cell resistance is increasing, change three-position switch 32 from the "low" position, which has previously been calibrated to deliver alumina to the cell at a lesser rate than the rate of consumption, to the "high" position which has previously been calibrated to deliver alumina to the cell at a rate in excess of the rate of consumption. As the bath alumina concentration then increases by virtue of the faster feeding rate, the cell resistance at first declines, then seemingly remains constant, and finally can be observed to be increasing at the alumina content 55''. When the cell resistance is indicated to be increasing, or to have remained approximately constant for a selected period of time, switch 32 is changed from the "high" to the "low" position, and the cell resistance is reduced as the alumina concentration decreases again toward 53. Thus, by periodically setting switch 32 according to the variations of cell resistance, the bath alumina concentration is maintained within the limits as desired.

Inclusion of computer means 40 in the control system normally permits detection of changes in the resistance-time curve more acutely than can be accomplished by the operator. Thus, computer 40 may be used if desired to sense a control limit 53' at higher concentration than 53 so that bath concentration may be kept within the narrower ranges 53' to 55'' or 53' to 55'. Additionally, if feeder means 24 through feed rate controller 31 and switch 32 is responsive to computer 40, the operator may be substantially relieved of his responsibilities in the control of cell ore content.

Although the continual removal of carbon from the anode creates potential increase in the A-C distance, and hence in the resistance of the cell, it has been found that this effect occurs slowly enough (in conventionally designed alumina reduction cells wherein the cathode area is larger than the adjacent anode surface) that the ability to control cell alumina content in the foregoing manner is not impaired. The small changes in resistance that occur from this cause are adequately taken care of by anode resetting after metal tapping, and by infrequent periodic resettings of the anode to the desired A-C distance where needed.

CONTROL OF LEDGING

Some alumina reduction cell designs are known in which it is desirable to protect the substantially vertical surfaces of cell lining 13 or shell 11 from corrosion and erosion by maintaining a "ledge" or layer of frozen electrolyte in the cell (see **55*a* in FIG. 1**). Control of the thickness of this ledge may be critical and is presently based on the judgement of the operator. This approach may be improved by using in the control system according to the present invention a set of three concentration limits in which ledge thickness is slowly reduced, maintained constant, or slowly increased, respectively. An operator subsequently need only select one of these control ranges as in his judgement the ledge is too thick, about right, or too thin.

DETECTION OF UPSET CONDITIONS

The signal from a.c. component amplifier 33 displayed on indicator means 34, which may comprise an indicating meter or one or more signal lights, instructs the operator or the computer 40 of an upset condition in the cell, and the nature of its cause may be determined from other considerations. During desirable operating conditions the strength of said signal will be relatively low for multiple-block anodes (and will be substantially reproducibly constant for single, large-flat-surface anodes as, for instance, Soderberg anodes).

If the signal strength rises above its normal value after breaking in a portion of the crust 17, the operator or computer will recognize the upset as being due to the presence of alumina-containing sludge in the cell. In this condition the next manual feeding is omitted or switch 32 of feed rate controller 31 is thrown to the "off" position. An anode adjustment ordinarily is neither necessary nor desirable at this point. Operation of the cell is continued without feeding until the signal of indicator 34 has returned substantially to its normal value or the need for resuming feeding otherwise is indicated.

A high reading on indicator 34 in the absence of upsets caused by tapping or massive feeding indicates that one or more of the blocks 16 is set low with respect to the other blocks and is carrying an excessive amount of current. This condition arises frequently in conventionally operated multiple block anode cells, causing a reduction in cell output and sometimes leading to melting of the metallic connection to the subject block. Upon noting a high reading on indicator 34 and further noting that the cell has not just previously been tapped or fed massively, the multiple-block anode cell operator will adjust the position of the individual blocks 16 relative to each other so that each block is carryingits proportionate share of current, using a suitable means of measuring the current to each block. Such current measuring means may comprise calibrated resistors in the electrical circuit between block 16 and anode bus 20 or, preferably, a portable rod-current meter to measure the current in rod 21 such as described in copending application Ser. No. 342,506 of Lester H. Wolgast filed Feb. 4, 1964, now abandoned; c.f. Canadian Pat. No. 791,284.

Although it is recognized that substantial differences in current carrying capacity exist among the several blocks that comprise a multiple-block anode, in conventional practice the operator still adjusts each block to about the same current loading, primarily because there previously has been available no convenient method of accurately predicting what the current loading would be for each block, and the operator therefore has relied upon the natural tendency of the system to adjust itself during operation. It has been found, however, that self-adjustment proceeds so slowly, and is so frequently upset by attempts of the operator to adjust the individual blocks, that optimum adjustment of multiple-block anodes seldom is attained. A method of distributing current which is suitable for use in conjunction with the present invention in this regard is disclosed and claimed in copending application Ser. No. 397,755 of John L. Dewey filed Sept. 21, 1964, now U.S. Pat. No. 3,491,002.

If the cell resistance $R_c$ increases above its normal value at the optimum ore content 54 while indicator 34 is at its normal condition, the cell is becoming overheated and the multiple anodes 16 are lowered to reduce cell resistance and power input to the cell.

For a Soderberg cell, however, a persistent change of indicator 34 from normal when the cell has not been subject to upset by tapping or crust breaking may indicate the approach or onset of an electrical short-circuit across molten electrolyte layer 15 between the anode and molten aluminum layer 14, requiring the initiation of corrective action to remove an anode protrusion.

On the other hand, somewhat different control procedures are employed in connection with tapping the cell to remove aluminum. It has been found desirable, for instance, to adjust the A-C distance following completion of the tapping operation, by setting the anode-cathode spacing to an initially higher cell resistance than otherwise would be optimum under more stable operating conditions; and it is ordinarily advisable in these circumstances also to interrupt manual feeding or set the feeder at its low rate of feed. Operation of the cell is continued thereafter to allow response to these control actions, and additional control steps may follow upon the occurrence or reoccurrence of an upset condition; but in the absence of upset, the A-C distance may then be readjusted successively closer to the desired setting for normal operation as the cell returns to stable behavior.

If an upset condition subsequently is detected, this is interpreted as indicating the need to check for a low carbon (in the manner of dealing with upsets not associated with tapping or massive feeding of the cell, discussed previously). However, if an upset is detected during operation at the higher resistance setting, the persistence of an indication of upset is related to development of a sludging condition which necessitates ceasing to feed alumina into the bath and may also require raising the anode, especially if the A-C distance has been readjusted meanwhile from the aforesaid higher resistance setting. Feeding is discontinued entirely or else the feeder is set at a reduced rate not greater than its low rate of feed until the indication of upset is eliminated.

In general, therefore, the A-C distance is increased somewhat following a tapping operation; and readjustment thereof toward normal cell resistance (corresponding to an optimum A-C distance for continuing operation of the cell) is carried out only in the absence of upsets occasioned either by a sludging condition due to excessive undissolved alumina or by a low carbon.

ADJUSTING A-C DISTANCE

When practicing the aforedescribed portions of this invention the bath alumina concentration is maintained within a predetermined range. Upon detecting that the alumina concentration is at a known value within the control range, the operator will consider the need for adjusting the anode to achieve a cell resistance corresponding to a predetermined optimum value of A-C distance; and thereafter will maintain the anode position substantially constant throughout the balance of the alumina control cycle. When the bath alumina concentration again reaches the same or another known value, the operator will repeat the process of adjusting the anode position as required.

The method of determining the optimum A-C distance and of calculating therefrom the corresponding value of cell resistance will be understood from the following discussion. The effective A-C distance of the cell may be obtained from a mathematical relation derived from the results of a few simple tests performed while the alumina concentration is maintained substantially constant. The A-C distances so obtained are then plotted against corresponding values of a cell performance characteristic such as the production rate, obtained from knowledge of the weight of alumina added to the cell or the weight of aluminum removed from the cell over a suitable period, or by other methods, and the A-C distance corresponding to the maximum cell production rate is estimated from the plot. This optimum value of A-C distance is then used to calculate the corresponding resistance of the cell for a predetermined power input to the plant.

The value of the cell resistance $R_c$ is obtained for the particular alumina content as the sum of:

1. External resistance, $R_{ext}$, which consists of the sum of the ohmic resistances in the electrical circuits of (a) the anode system between and inclusive of anode bus 20 and carbon block 16 and of (b) the cathode system between and inclusive of the molten aluminum layer 14 and the cathode bus 19, which are measured periodically with suitable electrical measuring means;

2. The resistive portion of the overvoltage, $R_{ov}$, which is obtained as the first derivative of the anode overvoltage with respect to cell current from measurements at several cell currents of the voltage difference between (a) a carbon or graphite reference electrode bathed with a constant composition mixture of $CO_2$ and CO (N. E. Richards & B. J. Welch, "Extractive Metallurgy of Aluminum" Volume 2, John Wiley & Sons, 605 Third Ave., New York 16,1963) and contacting the molten electrolyte within a through-hole in the carbon block 16; and (b) a point within block 16 adjacent said through-hole and adjacent the bottom of said block but protected from access of the molten electrolyte; and 3. The resistance of the molten electrolyte, $R_B$, which is given by the relation $$R_B = Z/KA_e \qquad (1)$$

wherein Z is the A-C distance in appropriate units; K is the conductivity of the molten electrolyte in consistent units and may be measured, or obtained from electrolyte analyses and published data, and $A_e$ is the effective conduction area of the molten electrolyte, estimatable from electrical analog models; and wherein the value of $1/KA_e$ may be determined as the first derivative of cell resistance with respect to Z from measurements of total cell resistance at several defined positions of the anode. It is preferred to perform these measurements during periods when the cell is operating normally under stable operating conditions, viz.: (1) the superimposed alternating current component of the cell voltage has substantially its normal value as previously discussed; (2) the cell has not recently been tapped, or fed massively as by breaking in the crust; (3) the cell electrolyte temperature is within its normal operating range, which is generally considered for prebake cells to be about 980°– 1000° C and for Soderberg cells about 970° to 990° C and which depends substantially on the location within the cell at which the temperature is measured; and (4) for multiple-block anode cells, any newly set blocks have attained, say, 80 percent or better of their normal current loading.

Thus, a mathematical relation for the determination of A-C distance and calculation of the corresponding cell resistance at the selected alumina concentration is $R_{cell} = R_{ext} + R_{ov} + Z/KA_e$ (2). It has been found that $R_{ext}$ may vary with the age of the cell, the presence or absence of sludge, and the condition of the anode and hence should be measured frequently; $R_{ov}$ depends primarily on the physical size of the carbon blocks 16 and the chemical constitution and method of manufacture of said carbon blocks and hence need be determined only infrequently; and $A_e$ depends primarily on the size of the carbon blocks 16 and the degree of ledging along the cell sidewalls and, slightly, on the A-C distance and depth of immersion of the block 16 in the molten electrolyte, and hence is preferably redetermined whenever a substantial change is made in the normal value of one or more of these factors.

We have further found that that portion of $R_{ov}$ which varies with the chemical composition and methods of manufacture of the anode carbon may be determined readily from laboratory measurements of overvoltage made, for instance, in accordance with the methods described by Richards and Welch (op cit). Those skilled in the art will recognize that such data, in combination with the methods of optimizing the A-C distance in accordance with the invention, provide a method of estimating the economic impact of proposed changes in carbon composition or in carbon manufacture before committing such proposals to expensive and lengthy tests on the production line in conventional manner.

The A-C distance is converted into an optimum cell resistance by application of equation 2, and the alumina reduction cell is set to said optimum resistance value periodically during the process of controlling the alumina concentration within selected limits.

As used in this application, reference to "frequent intervals" concerns actions or events occurring every 5 minutes or so, and that terminology is intended to cover substantially continuous operations as well as those which occur periodically at regular or irregular intervals. The term "periodically" is not limited to repeated occurrences at regular intervals, but is used in the sense of "from time to time."

While the presently preferred practices of the invention have been described, it will be appreciated that the invention may be otherwise variously embodied and practiced with the scope of the following claims.

We claim:

1. In the process of refining aluminum from alumina in an igneous electrolysis bath in an electrolytic refining cell, the method of controlling the alumina content of said bath by signalling a feed operation to feed additional alumina into said bath prior to the occurrence of an anode effect therein comprising the steps of:

(1. ) measuring by an instrumentality the operating electrical current and voltage of said electrolytic refining cell at predetermined time intervals, and responding thereto to develop signals representing the value of total pot resistance of said cell at said predetermined time intervals, (2. ) comparing by an instrumentality said signal representing the current resistance value with a signal representing the most recent previous resistance values derived from previous measurements to supply signals representing the time rate of change of said total pot resistance, (3.) signalling by an instrumentality said feed operation when said signals representing time rate of change of said total pot resistance reach a predetermined limit.

2. A method according to claim 1 wherein step 1 comprises the steps of:

A. measuring by an instrumentality the current through the cell to develop a signal representing the value of said current, B. measuring by an instrumentality the voltage across the cell to develop a signal representing the value of said voltage, C. responding to said current and voltage value representing signals by an instrumentality to develop thereby signals representing the value of total pot resistance from said measured values at said predetermined time intervals.

3. A method according to claim 1 wherein determination of said time rate of change of said total pot resistance of step 2 comprises the steps of:

A. supplying by an instrumentality a signal representing the average previous resistance value from a predetermined number of signals representing the most recent previous resistance values, B. subtracting by an instrumentality a signal representing the filtered value of said current resistance value from said signal representing said average previous resistance value to obtain signals representing the time rate of change of said total pot resistance, C. accumulating by an instrumentality the positive values of said time rate of change signals obtained in step B.

4. A method according to claim 3 including the additional steps of

A. calculating by an instrumentality a new filtered value of resistance for each pot.

5. In a system for the electrolytic refining of aluminum from alumina by means of a plurality of serially connected cells, apparatus for controlling the alumina content of each of said cells by signalling feed operations to feed additional alumina into individual ones of said cells prior to the occurrence of an anode effect therein comprising:

current sensing means for developing a signal representing the current in said cell line, voltage sensing means for developing a signal representing the voltage across a cell, signal transfer means, a plurality of feed indicator means, each associated with one of said cells, for indicating that a feed operation is required for the associated cell, control means for said sensors, said signal transfer means and said feed indicator means, said control means including a digital computer arranged to comprise:

1. means for operating said signal transfer means to effect periodic interrogation of said sensors by said signal transfer means and transfer of said current and voltage signal data to said computer;
2. means responsive to said transfered current and voltage signal data to develop signals representing the value of total pot resistance of each cell at said periodic time intervals;
3. means responsive to said signals representing the value of total pot resistance at said time intervals to compare said signal representing the current resistance value of a cell with a signal representing the most recent previous resistance values of said cell to determine the time rate of change of said total pot resistance for each of said cells; and
4. means for operating said feed indicator means for a cell when said time rate of change of said total pot resistance for said cell exceeds a predetermined value.

6. A system according to claim 5 having analog to digital converter means operable in accordance with said control means for converting the analog output of said sensors to digital form for transfer to said computer.

7. In the process of refining aluminum from alumina in an igneous electrolysis bath in an electrolytic refining cell, the method of controlling the alumina content of said bath by signalling a feed operation to feed additional alumina into said bath prior to the occurrence of an anode effect therein comprising the steps of:

1. Measuring by an instrumentality the operating electrical current and voltage of said electrolytic refining cell at frequent time intervals, and responding thereto to develop signals representing the value of total pot resistance of said cell at frequent time intervals,
2. Comparing by an instrumentality said signal representing the current resistance value with signals representing the resistance values derived from previous measurements to supply signals representing the time rate of change of said total pot resistance,
3. Signalling by an instrumentality said feed operation when said signals representing time rate of change of said total pot resistance reach a predetermined limit.

8. A method according to claim 7 wherein step 1 comprises the steps of:

A. Measuring by an instrumentality the current through the cell to develop a signal representing the value of said current, B. Measuring by an instrumentality the voltage across the cell to develop a signal representing the value of said voltage, C. Responding to said current and voltage value representing signals by an instrumentality to develop thereby signals representing the value of total pot resistance from said measured values at said frequent time intervals.

9. In a system for the electrolytic refining of aluminum from alumina by means of a plurality of serially connected cells, apparatus for controlling the alumina content of each of said cells by signalling feed operations to feed additional alumina into individual ones of said cells prior to the occurrence of an anode effect therein comprising:

current sensing means for developing a signal representing the current in said cell line, voltage sensing means for developing a signal representing the voltage across a cell, signal transfer means, a plurality of feed indicator means, each associated with one of said cells, for indicating that a feed operation is required for the associated cell, control means for said sensors, said signal transfer means and said feeder indicator means, said control means including a digital computer arranged to comprise:

1. means for operating said signal transfer means to effect periodic interrogation of said sensors by said signal transfer means and transfer of said current and voltage signal data to said computer;
2. means responsive to said transferred current and voltage signal data to develop signals representing the value of total pot resistance of each cell at periodic time intervals;
3. means responsive to said signals representing the value of total pot resistance at said time intervals to compare a signal representing the current resistance value of a cell with signals representing previous resistance value of said cell to produce signals indicating the time rate of change of said total pot resistance for each of said cells; and
4. means for operating said feed indicator means for a cell when said signals indicating time rate of change of said total pot resistance of said cell exceed a predetermined value.

10. A system according to claim 9 having analog to digital converter means operable in accordance with said control means for converting the analog output of said sensors to digital form for transfer to said computer.

11. In the process of refining aluminum from alumina in an igneous electrolysis bath in a electrolytic refining cell, the method of controlling the alumina content of said bath by signalling a feed operation to feed additional alumina into said bath prior to the occurrence of an anode effect therein comprising the steps of:

1. Measuring by an instrumentality the operating electrical current and voltage of said electrolytic refining cell at known time intervals, and responding thereto develop signals representing the value of total pot resistance of said cell at known time intervals,
2. Comparing by an instrumentality said signal representing the current resistance value with signals representing the resistance values derived from previous measurements to supply signals representing the time rate of change of said total pot resistance,
3. Signalling by an instrumentality said feed operation when said signals representing time rate of change of said total pot resistance reach a predetermined limit.

12. A method according to claim 7 wherein determination of said time rate of change of said total pot resistance of step 2 comprises the steps of:

A. Supplying by an instrumentality a signal representing the average previous resistance value from a predetermined number of signals representing the most recent previous resistance values, B. Subtracted by an instrumentality a signal representing the filtered value of said current resistance value from said signal representing said average previous resistance value to obtain signals representing the time rate of change of said total pot resistance, C. Accumulating by an instrumentality the positive values of said time rate of change signals obtained in step B.

13. A method according to claim 12 including the additional steps of:

A. Calculating by an instrumentality a new filtered value of resistance for each pot.

14. In the operation of an electrolytic cell for the production of aluminum from alumina dissolved in a molten salt bath, wherein the total pot resistance of said cell is affected by variations in the bath alumina concentration and by changes in the spacing between anode and cathode electrodes for passing electric current through the bath, the method of controlling the alumina content of said bath by signalling a feed operation to feed additional alumina into the bath prior to the occurrence of an anode effect comprising the steps of:

1. measuring by an instrumentality the operating electrical current and voltage of said cell, and responding thereto to develop signals representing the time rate of change of said total pot resistance of the cell, and
2. signalling by an instrumentality said feed operation when said signals reach a predetermined condition indicating an increasing rate of change of total pot resistance.

15. The method of claim 14, wherein step (2) comprises:

signalling said feed operation when said increasing rate of change of total pot resistance occurs during a period of operating the cell without feeding.

16. The method of claim 14, wherein step (2) comprises:

signalling said feed operation when said increasing rate of change of total pot resistance follows a downward trend in pot resistance of said cell.

17. The method of claim 14, including the steps of:

feeding alumina into the bath in response to said signalling, continuing said feeding to cause a downward trend in total pot resistance, and signalling a further feeding operation when said signals indicate an increasing rate of change of total pot resistance following said downward trend.

18. The method of claim 14 wherein step (1) comprises:

A. measuring by an instrumentality the current through the cell to develop a signal representing the value of said current, B. measuring by an instrumentality the voltage across the cell to develop a signal representing the value of said voltage, C. responding to said current and voltage value representing signals by an instrumentality to develop thereby signals representing the value of total pot resistance from said measured values at known time intervals.

19. The method of claim 18 wherein step (C) comprises responding to said current and voltage signals to develop resistance signals according to the relationship $R = (E-k/I)$ where R is the cell resistance;
E is the measured voltage value;
I is the measured current value;
k is a predetermined voltage characteristic of the cell.

20. In the operation of an electrolytic cell for the production of aluminum from alumina dissolved in a molten salt bath by passing electric current through said bath between adjustably spaced electrodes, the method of controlling the bath alumina content comprising the steps of:

1. producing signals representing the time rate of change of the total pot resistance of said cell; and
2. regulating the feeding of alumina into the bath in response to said signals, wherein said regulating includes connecting a feed operation when said rate of change of total pot resistance is increasing and continuing to feed at a rate of feeding sufficient to avoid the occurrence of an anode effect.

21. In the operation of an electrolytic cell for the production of aluminum from alumina dissolved in a molten salt bath by passing electric current through said bath between adjustably spaced electrodes, the method of controlling the alumina content of said bath by signalling a feed operation to feed additional alumina into the bath prior to the occurrence of an anode effect comprising the steps of:

1. measuring the operating electrical current and voltage of said cell, and responding thereto to develop signals representing the time rate of change of cell resistance;
2. signalling said feed operation in response to said rate of change signals, so as to feed alumina into the bath of said cell during a period of operation in which its rate of change of cell resistance is increasing; and
3. continuing said feed operation at a rate of feeding sufficient to cause a downward trend in cell resistance.

22. In a system for the production of aluminum from alumina by electrolysis in a plurality of serially connected reduction cells, apparatus for controlling the alumina content of each of said cells by signalling feed operations to feed additional alumina into individual ones of said cells prior to the occurrence of an anode effect comprising:

current sensing means for developing a signal representing the current in said cell line, voltage sensing means for developing a signal representing the voltage across a cell, a plurality of feed indicator means, each associated with one of said cells, for signalling a feed operation for the associated cell, control means for said cells and their feed indicator means, including:

1. means responsive to said current and voltage signal data from said sensing means to develop signals representing the time rate of change of total pot resistance for each of said cells; and
2. means for operating said feed indicator means for a cell when said signals indicate an increasing rate of change of its total pot resistance.

23. Apparatus according to claim 22, wherein said control means are arranged to operate said feed indicator means for signalling a feed operation when said signals indicate an increasing rate of change of total pot resistance during operation of the cell without feeding.

24. Apparatus according to claim 23, including means for feeding alumina into the bath in response to said signalling.

25. Apparatus according to claim 22, wherein said control means are arranged to operate said feed indicator means for signalling a feed operation when said signals indicate an increasing rate of change of total pot resistance following a downward trend in pot resistance of said cell.

26. Apparatus according to claim 25, including means for feeding alumina into the bath in response to said signalling.

27. In a system for the production of aluminum from alumina by electrolysis in a plurality of serially connected reduction cells, apparatus for controlling the alumina content of each of said cells by signalling feed operations to feed additional alumina into individual ones of said cells prior to the occurrence of an anode effect comprising:

current sensing means for developing a signal representing the current in said cell line, voltage sensing means for developing a signal representing the voltage across a cell, signal transfer means, a plurality of feed indicator means, each associated with one of said cells, for signalling a feed operation for the associated cell, control means for said sensing means, said signal transfer means and said feed indicator means, wherein said control means are arranged to comprise:

1. means for operating said signal transfer means to effect periodic interrogation of said sensing means and obtain said current and voltage signal data of a cell;
2. means responsive to said current and voltage signal data from said signal transfer means to develop signals representing the value of total pot resistance of each cell at known time intervals;
3. means responsive to said signals representing the value of total pot resistance to develop signals representing the time rate of change of total pot resistance for each of said cells; and
4. means for operating said feed indicator means for a cell when said signals indicate an increasing rate of change of its total pot resistance.

28. In a system for the production of aluminum from alumina by electrolysis in a plurality of serially connected reduction cells, apparatus for controlling the alumina content of each of said cells by signalling feed operations to feed additional alumina into individual ones of said cells prior to the occurrence of an anode effect comprising:

current sensing means for developing a signal representing the current in said cell line, voltage sensing means for developing a signal representing the voltage across a cell, a plurality of feed indicator means, each associated with one of said cells, for signalling a feed operation for the associated cell, control means for said feed indicator means, wherein said control means are arranged to comprise:

1. means responsive to said current and voltage signal data from said sensing means to develop signals representing the value of total pot resistance of each cell at known time intervals;
2. means responsive to said signals representing the value of total pot resistance to develop signals representing the time rate of change of total pot resistance for each of said celss; and
3. means for operating said feed indicator means for a cell when said signals indicate an increasing rate of change of its total pot resistance during a period of operating the cell without feeding.

* * * * *